US008827627B2

(12) United States Patent
Landry et al.

(10) Patent No.: US 8,827,627 B2
(45) Date of Patent: Sep. 9, 2014

(54) ROTATABLE BUCKET FOR ATTACHMENT TO THREE POINT HITCH OF TRACTOR

(76) Inventors: Ronnie Joseph Landry, Houma, LA (US); Chase Michael Landry, Houma, LA (US)

( * ) Notice: Subject to any disclaimer, the term of this patent is extended or adjusted under 35 U.S.C. 154(b) by 675 days.

(21) Appl. No.: 13/011,300

(22) Filed: Jan. 21, 2011

(65) Prior Publication Data

US 2011/0217152 A1 Sep. 8, 2011

Related U.S. Application Data

(60) Provisional application No. 61/339,494, filed on Mar. 5, 2010.

(51) Int. Cl.
*E02F 3/627* (2006.01)
*E02F 3/04* (2006.01)

(52) U.S. Cl.
CPC ..... *E02F 3/04* (2013.01)
USPC ..... 414/725; 414/722; 37/443; 37/444

(58) Field of Classification Search
USPC ..... 414/722, 725, 928; 37/443, 444
See application file for complete search history.

(56) References Cited

U.S. PATENT DOCUMENTS 3,109,248 A * 11/1963 Vos ..... 37/408
3,209,475 A * 10/1965 Karl ..... 37/408
4,633,601 A * 1/1987 Fleck et al. ..... 37/444
4,798,511 A 1/1989 Kaczmarczyk et al.
D319,448 S 8/1991 Ball et al.
5,125,787 A * 6/1992 Ball et al. ..... 414/722
5,267,402 A 12/1993 Russell et al.
5,315,772 A 5/1994 Lalonde
5,416,990 A * 5/1995 Otwell ..... 37/445
5,526,591 A * 6/1996 Otwell ..... 37/444
6,408,551 B1 * 6/2002 Pettersson ..... 37/409
6,725,583 B2 4/2004 Sprinkle et al.
7,562,473 B2 * 7/2009 Westendorf et al. ..... 37/407

* cited by examiner

*Primary Examiner* — Kaitlin Joerger

(74) *Attorney, Agent, or Firm* — Law Office of Jesse D. Lambert, LLC

(57) ABSTRACT

Apparatus for the moving and spreading of loose materials, such as dirt. A frame attaches to the three point hitch on a tractor. A bucket is rotatably attached to the frame, and a blade is attached to the frame and positioned within the bucket so as to substantially span the height and width of the bucket interior. In a first position, the bottom wall of the bucket is positioned substantially horizontally. The tractor moves so as to insert the open mouth of the bucket into a quantity of loose material, then raises the bucket and moves to a desired location. The bucket is lowered so that drag members on the bucket contact the ground; forward movement of the tractor causes the bucket to rotate, creating an opening between the bucket and the blade and causing the loose material to flow out of the bucket onto the ground.

4 Claims, 4 Drawing Sheets

ROTATABLE BUCKET FOR ATTACHMENT TO THREE POINT HITCH OF TRACTOR

CROSS REFERENCE TO RELATED APPLICATIONS

This regular United States patent application claims priority to U.S. Provisional Patent Application Ser. No. 61/339,494, filed Mar. 5, 2010, for all purposes.

BACKGROUND

1. Field of the Invention

This invention relates, generally, to apparatus and methods used in conjunction with a tractor or similar vehicle, to move volumes of loose material such as dirt, sand, shell, rock, limestone, fertilizer, etc. from one location to another, and to spread the material on a surface, e.g. a ground surface, such as a road surface, building site, agricultural field, etc.

2. Related Art

In various settings, such as agricultural, roadwork, earthen surface preparation, etc. it is frequently necessary to move loose material from a first location, for example a pile of material on the ground, to a second location, and to spread the material in a relatively uniform layer at or around the second location. Examples include:

- moving and spreading dirt, rock, shell, limestone for a road or path
- building up an earthen pad in preparation for a building foundation
- spreading earth, fertilizer, etc. on a soil surface in preparation for agricultural work.

Of course, relatively small volumes can be moved and spread by human power alone, using shovels, rakes and the like. However, larger volumes suggest the use of power equipment, such as a tractor.

However, the tractor must be suitably equipped to move loose materials. As is well known, most tractors have a so-called "three point attachment" or "three point hitch" on the rear end of the tractor. Three-point hitches generally comprise three movable arms, which (when viewed end-on, and as is well known in the relevant art) comprise three attachment points arranged in a triangle, with two lower arms at the base of the triangle and a third, upper arm at the apex of the triangle. The two lower arms—the hitch lifting arms—are controlled by the tractor's hydraulic system, and provide lifting and lowering to the arms and to any implement attached to the arms. The center or upper arm is movable, but is usually not powered by the tractor's hydraulic system. Each arm has an attachment device (often a simple plate with a hole) at its end distal from the tractor to connect implements to the hitch. The implement has a similar attachment device that is aligned with the arm attachment device, and can be attached to the tractor by placing pins through the aligned holes. Other attachment arrangements are possible.

One powered means to move loose materials from one location to another, and to spread them, is a powered scoop carried on the front end of a tractor, typically called a "front end loader." This device uses a combination of mechanical and hydraulic means to enable moving a bucket up and down, and to rotate the bucket around a horizontal axis without additional vertical movement. While various arrangements of front end loaders exist, in general these are relatively large, expensive apparatus that many users do not have. Generally, in contrast with the three point hitch, a front end loader is not a "standard equipment" item on most tractors. It is not cost effective for many persons to purchase a tractor already having a front end loader, or to add one on to a currently owned tractor. It is understood that front end loaders do not connect to the three point hitch of a tractor.

SUMMARY

In accordance with the invention, the problem of moving and spreading of loose materials, using a tractor or similar vehicle, is solved by an apparatus having a frame with a bucket rotatably attached to the frame, with a fixed blade positioned within the bucket, the apparatus attaching to the three point hitch of a tractor. When the apparatus is mounted on the three point hitch of the tractor and positioned with the bottom wall of the bucket just clearing the ground surface (the bucket being in a first position, generally horizontally positioned), the operator moves the tractor backward to a pile of loose material, forcing the rearward-facing, open mouth of the bucket into the material and thereby depositing a quantity of the loose material into the bucket. The blade blocks the open back of the bucket. The operator then lifts the apparatus a sufficient distance to clear the ground surface, and drives the tractor to a desired location to dump the material. At the desired location, the apparatus is lowered until one or more drag members on the bucket contact the ground; then, with forward motion of the tractor, the bucket is forced to rotate on the frame, creating an opening between the blade and the bucket and rotating the bucket a sufficient amount that the loose material flows through the opening onto the ground surface as the tractor moves forward.

DETAILED DESCRIPTION

Structure of the Apparatus

Figure 1:
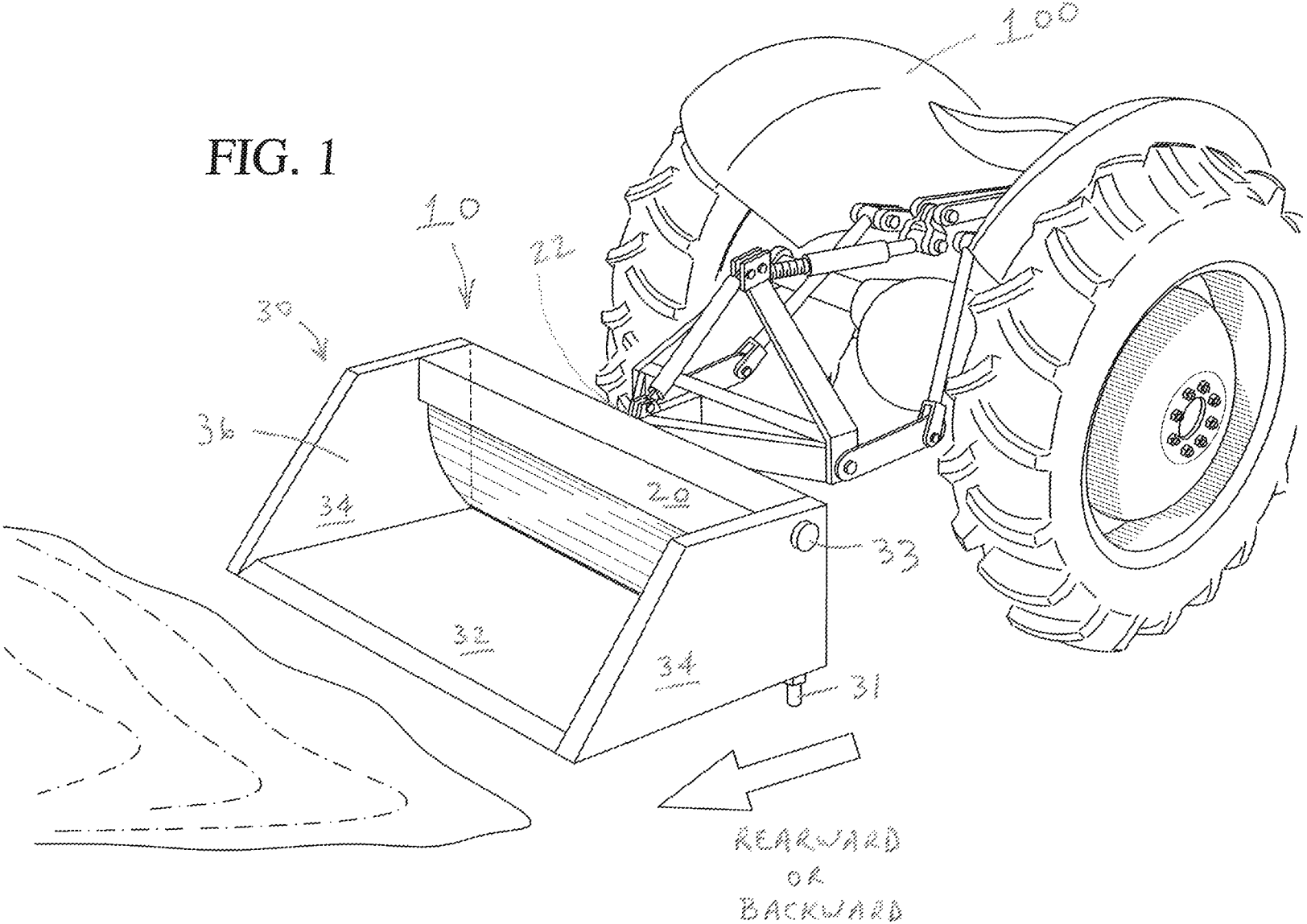
FIG. 1 is a perspective view of a rotatable bucket apparatus embodying the principles of the present invention.

The apparatus 10 embodying the principles of the present invention comprises a frame 20 having one or more attachment points 22 for attachment to a vehicle, such as a tractor 100, and more specifically to the three point hitch of a typical tractor. As is known in the art, attachment points 22 typically comprise structural members with holes through them, which are aligned with the holes on the members of the three point hitch of the tractor. Pins can be inserted through the aligned holes to connect the frame to the tractor. Other attachment means may be used, such as some form of mating, locking members, threaded attachments, or even permanent or semi-permanent attachment such as welding. However, it is contemplated that some form of disconnectable attachment will be used.

A bucket 30 is rotatably attached to frame 20 by a pin type connection 33 or other means well known in the art. Bucket 30 has a bottom wall 32 and side walls 34, forming a rearwardly-facing (with respect to the tractor) open mouth 36 and a forward-facing open back 38. Bucket 30 is rotatable between a first position, shown in FIGS. 1-3, where bottom wall 32 is substantially horizontally positioned or inclined slightly downward in a rearward direction (that is, away from the tractor); and a second position, shown in FIG. 4, where bucket 30 is rotated a sufficient amount for loose material contained therein to flow out. Bucket 30 may also have one or more drag members 31 attached, which assist in rotating bucket 30 to its second position, as will be later described. Drag members 31 can take different shapes and be attached to different locations on bucket 30, so long as drag members 31 fulfill the function of contacting the ground surface and forcing bucket 30 to rotate upon forward motion of the tractor, as is later described. It is to be understood that "ground surface" as used herein is in its broadest meaning, and includes any surface on which the materials are to be deposited, including the ground, a roadway, concrete, asphalt or any other surface.

Attached to frame 20, and positioned within bucket 30, is a blade 40, as can be seen in the figures. Blade 40 is fixed in a generally vertically aligned position. As can be seen, especially in FIGS. 1, 2, and 3, blade 40 has a length and height sufficient to substantially block open back 38 of bucket 30, when bucket 30 is in its first position. However, as will be later described, when bucket 30 is rotated to its second position, an opening is formed between blade 40 and bucket 30. While the cross section shape of blade 40 (in the embodiment shown in the figures) has a lower section curved toward tractor 100, it is understood that this is by way of example only, and blade 40 could be substantially straight, curved to a different degree or in other directions, etc.

Materials suitable for fabrication of the apparatus are well known in the art, preferably metals of various suitable types. It is recognized that other materials could be used where suitable, such as high strength composite materials, etc.

Use of the Apparatus

Use of the apparatus will now be explained in conjunction with the drawings. For purposes of this application, the direction "forward" means the direction noted in the figures, and "backward" or "rearward" also as noted in the figures. As previously mentioned, frame 20 is connected to tractor 100, preferably by a standard three point hitch, pins, etc. The figures illustrate the apparatus as attached to the tractor.

Figure 2:
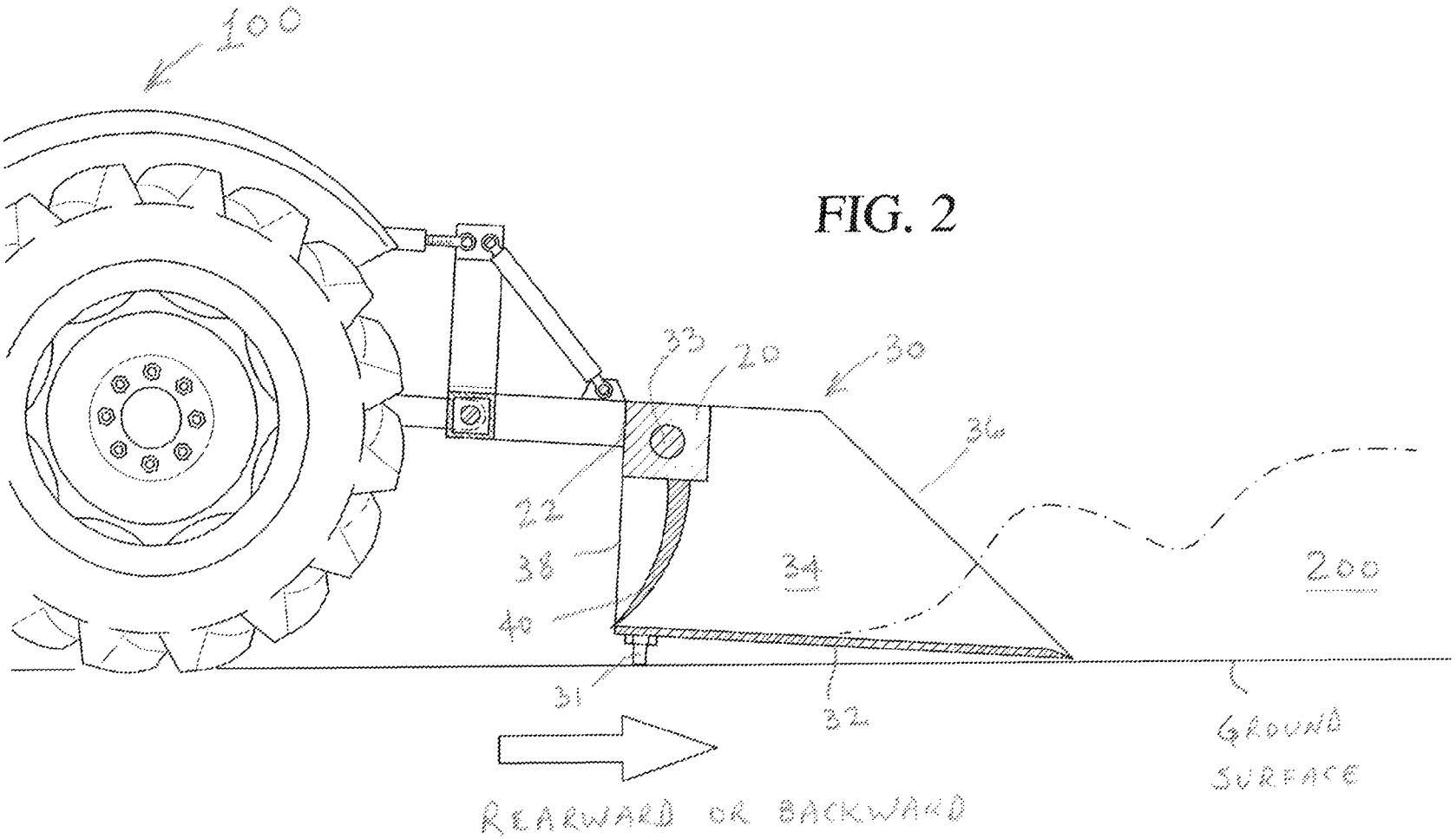
FIG. 2 is a side view of the apparatus shown in FIG. 1, showing the open mouth of the bucket being pushed into a pile of loose material.

With bucket 30 positioned such that bottom wall 32 is preferably just above ground surface (so as not to drag), bucket 30 is moved into a pile of loose material 200, by moving tractor 100 in reverse, as seen in FIGS. 1 and 2. As can be seen by the figures, a volume of the loose material 200 is thereby within the cavity of bucket 30. It is to be understood that the term "loose materials" is meant in its broadest sense, and includes any material small enough to fit within the bucket and to drop out of the bucket when rotated as described.

Figure 3:
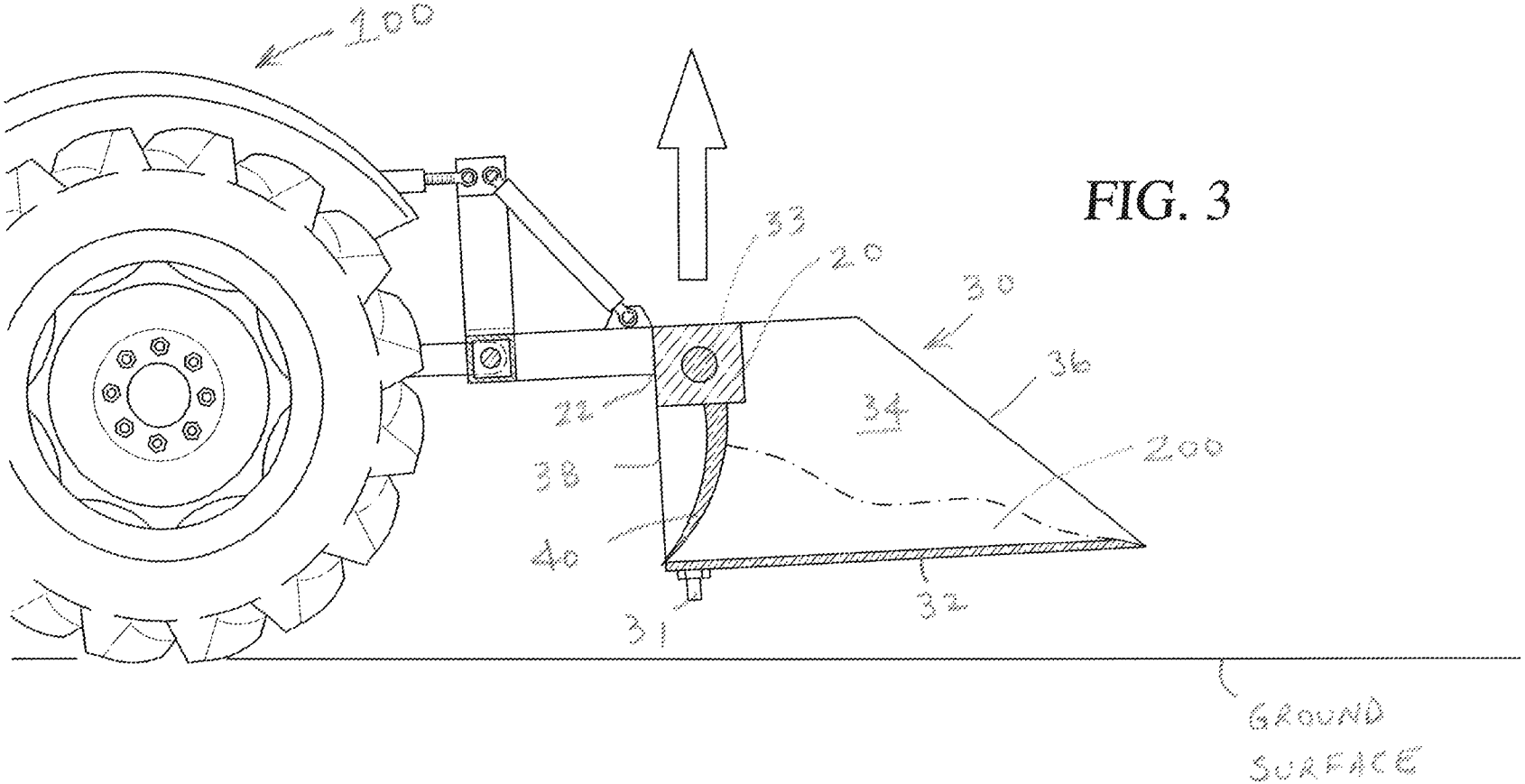
FIG. 3 is another side view of the apparatus shown in FIG. 1, showing the bucket lifted above the ground for transport.

Next, by raising the three point hitch, apparatus 10 is raised until bottom wall 32 of bucket 30 clears the ground surface, as shown in FIG. 3, capturing a volume of loose material 200 within bucket 30. As can be seen in the drawings, with bucket 30 in its first position, blade 40 blocks mouth 36 so that the loose material 200 cannot flow out of mouth 36.

Tractor 100 can then drive to the desired location for depositing the loose material contained within bucket 30.

Figure 4:
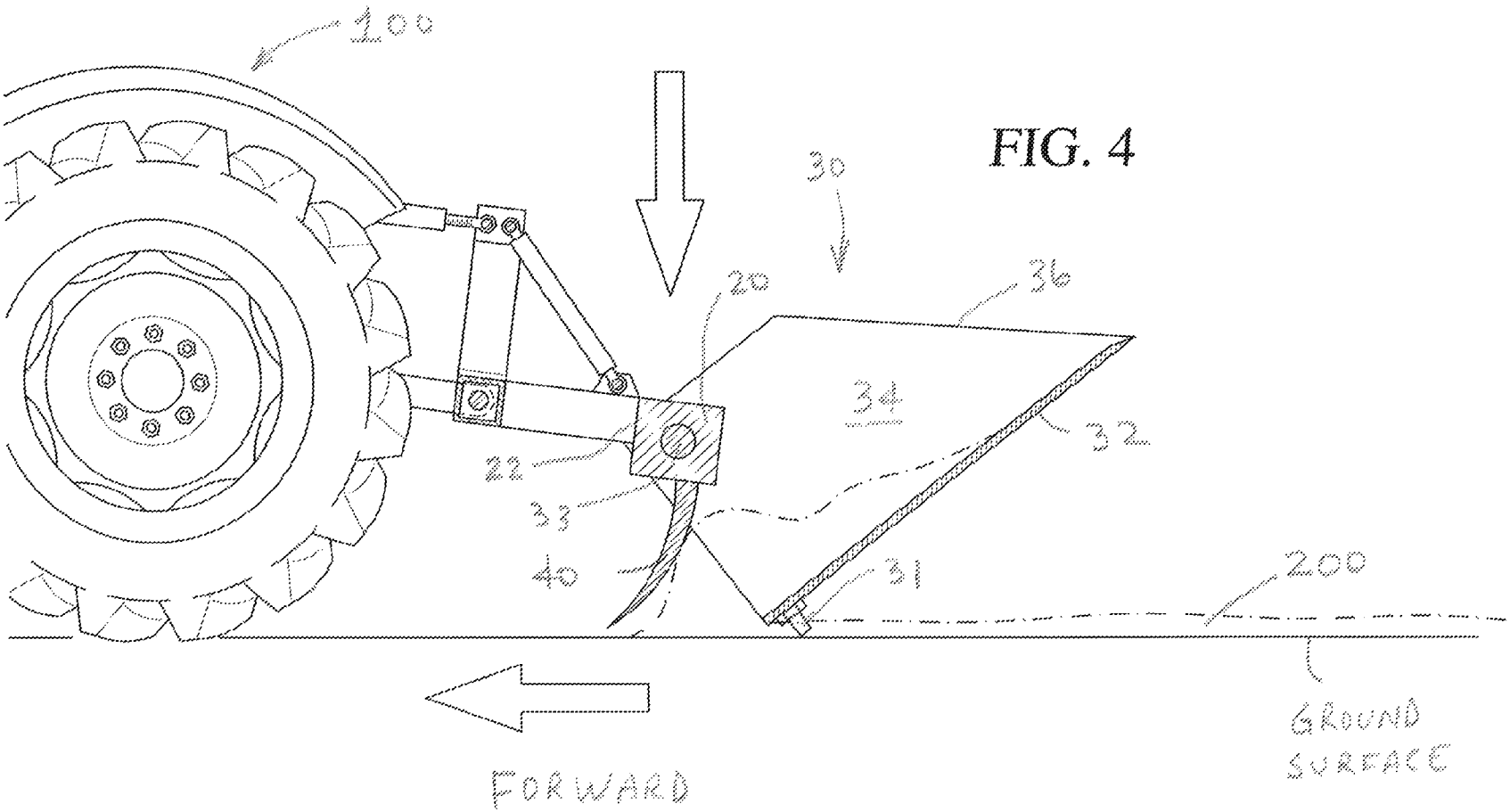
FIG. 4 is a side view of the apparatus shown in FIG. 1, showing the bucket rotated so as to create an opening and the loose material flowing out of the bucket and onto the ground surface under forward motion of the tractor.

Once at the desired location, with reference to FIG. 4, apparatus 10 is lowered via the three point hitch until drag members 31 contact the ground surface. Tractor 100 then drives forward, and as shown in FIG. 4 bucket 30 rotates around its attachment point 33, by the forces exerted on drag members 31. This rotation of bucket 30 creates an opening between blade 40 and bucket 30, and continued rotation (due to continued forward movement of tractor 100) tilts bucket 30 to a sufficient degree that the loose material therein flows out the opening onto the ground surface (FIG. 4). It can be appreciated that the size of the opening between blade 40 and bucket 30 can be regulated by the height at which apparatus 10 is held. By regulating the size of the opening, and the speed at which tractor 100 moves, the operator is able to control the rate at which the loose material is being dumped, and the thickness of the layer of loose material deposited.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example:

- the cross section shape of bucket 30 can be rectangular or rounded
- a top can be placed over at least a part of bucket 30
- the size, shape, and positioning of blade 40 within bucket 30 can be modified
- drag members 31 may be attached at different locations on bucket 30, and may take the form of pins, rectangular members, blocks, etc.; or in alternative embodiments, may be omitted altogether
- different attachment arrangements may be used to connect the apparatus to the tractor
- vehicles other than tractors, such as trucks, ATVs, etc. may serve to carry the apparatus
- sizes of the various elements of the apparatus may be changed to suit particular applications
- the loose materials can be spread on any surface Therefore, the scope of the invention is to be determined not by the illustrative examples set forth above, but by the appended claims and their legal equivalents.

We claim:

1. An apparatus, comprising:

a frame having attachment points for attachment to a vehicle;

a bucket rotatably mounted on said frame, said bucket having a bottom wall, side walls, an open mouth and an open back, said bucket rotatable between a first position wherein said bottom wall of said bucket is generally horizontally disposed with said open mouth facing rearward away from said vehicle and said open back facing forward toward said vehicle, and a second position wherein said bucket is rotated to a sufficient degree that loose material within said bucket flows out of said open back;

a blade fixed to said frame and disposed within said bucket between said open mouth and said open back, wherein when said bucket is in said first position said blade blocks loose material in said bucket from flowing out said open back, and when said bucket is in said second position an opening is formed between said blade and said bucket such that loose material within said bucket flows out of said open back;

further comprising drag members affixed to said bucket, whereby when said drag members are in contact with a ground surface and said vehicle is moving forward, said bucket rotates with respect to the frame such that said loose material flows out of said bucket.

2. An apparatus for attachment to a three point hitch on a vehicle, comprising:

a frame having attachment points for disconnectable attachment to a three point hitch on a vehicle;

a bucket rotatably attached to said frame, said bucket having a bottom wall and side walls defining a height and width and an open mouth facing away from said vehicle and an open back facing toward said vehicle;

a blade attached to said frame and positioned within said bucket between said open mouth and said open back, said blade being generally vertically positioned and having a width and height sufficient to substantially fill the height and width of said bucket;

drag members attached to said bucket, whereby when said drag members are in contact with a ground surface and said vehicle is moving forward, said bucket rotates with respect to said frame and creates an opening between said blade and said bucket, such that loose material contained within said bucket flows out through said opening.

3. The apparatus of claim 2, wherein said drag members comprise downwardly-extending pins attached to said bucket.

4. A method for moving loose materials from a first location to a second location, and spreading said loose materials at said second location, comprising the steps of:

providing an apparatus comprising:

a frame having attachment points for disconnectable attachment to a three point hitch on a vehicle;

a bucket rotatable attached to said frame, said bucket having a bottom wall and side walls defining a height and width and an open mouth facing away from said vehicle and an open back facing toward said vehicle;

a blade attached to said frame and positioned within said bucket between said open mouth and said open back, said blade being generally vertically positioned and having a width and height sufficient to substantially fill the height and width of said bucket; and drag members attached to said bucket, whereby when said drag members are in contact with a ground surface and said vehicle is moving forward, said bucket rotates with respect to said frame and creates an opening between said blade and said bucket, such that loose material contained within said bucket flows out through said opening;

positioning said bottom wall of said bucket above a ground surface;

moving said apparatus with said vehicle so that said bucket is inserted into a volume of loose material, thereby placing a portion of said loose material within said bucket;

moving said apparatus with said vehicle to a desired location;

lowering said vehicle so that said drag members contact a surface;

moving said vehicle forward so that said bucket rotates with respect to said frame, creating an opening between said bucket and said blade and causing a portion of said loose material to flow out of said bucket onto said surface.

* * * * *